United States Patent [19]

Luce

[11] 4,395,134

[45] Jul. 26, 1983

[54] JOYSTICK SWITCH FOR TIMEPIECES

[76] Inventor: Nunzio A. Luce, 39 Galston Dr., R.D. #4, Trenton, N.J. 08691

[21] Appl. No.: 349,516

[22] Filed: Feb. 17, 1982

[51] Int. Cl.[3] ..... G04B 47/00; G04F 8/00; G04F 10/00

[52] U.S. Cl. ..... 368/3; 368/10

[58] Field of Search ..... 368/3, 10; 273/85 G, 273/DIG. 28; 235/92 GA

[56] References Cited

U.S. PATENT DOCUMENTS

| | | | |
|---|---|---|---|
| 3,999,298 | 12/1976 | Nishimura | 33/141 R |
| 4,053,740 | 10/1977 | Rosenthal | 304/705 |
| 4,072,004 | 2/1978 | Tanaka et al. | 200/159 B |
| 4,093,221 | 6/1978 | Dash | 273/85 G |
| 4,142,180 | 2/1979 | Burson | 273/85 G |
| 4,148,014 | 4/1979 | Burson | 273/85 G |
| 4,188,779 | 2/1980 | Fatton | 235/92 GA |
| 4,231,090 | 10/1980 | Fatton | 235/92 GA |
| 4,306,232 | 12/1981 | Burson | 273/85 G |

FOREIGN PATENT DOCUMENTS

| | | | |
|---|---|---|---|
| 54-14840 | 2/1979 | Japan | 368/3 |
| 54-121852 | 10/1979 | Japan | 273/83 G |

*Primary Examiner*—Bernard Roskoski

*Attorney, Agent, or Firm*—Wigman & Cohen

[57] ABSTRACT

A multi-position joystick-type control switch for use with a combination timepiece and game is disclosed. Movement of the joystick into each of its positions causes displacement of a game element on the face of the timepiece in either the up, down, right or left direction. The joystick control switch is preferably for use with a microprocessor-controlled electronic game watch. Several embodiments of the switching socket of the joystick are disclosed. The joystick may be comprised of the switching socket and a rigid cylindrical rod threaded therein or a telescoping cylindrical rod portion. The joystick may be affixed to the watch band in a clip or compartment.

10 Claims, 9 Drawing Figures

JOYSTICK SWITCH FOR TIMEPIECES

BACKGROUND OF THE INVENTION

The present invention relates generally to switches for use in controlling timepiece functions and, more particularly, to a joystick-type switch useful for controlling timepiece functions. This type of switch has particular utility with regard to game watches, that is, watches or other timepieces which, in addition to performing traditional time-keeping functions, also contain game functions. Examples of such timepieces are pending applications Ser. Nos. 330,858 and 330,861, filed Dec. 15, 1981, by the instant inventor, and U.S. Pat. Nos. 4,188,779 and 4,231,090.

The above-referenced pending applications relate to digital electronic watches utilizing liquid crystal displays which are well-known in the art. The game disclosed in these pending applications, unlike the games disclosed in the above-mentioned U.S. Letters Patents, utilizes a two-layer LCD display, one for the timekeeping functions and the other for the game and is complex and microcomputer based. The instant joystick switch is likewise configured to be used with a microprocessor-controlled relatively complex game. The joystick switch of the present invention is designed to be used to control various game functions on timepieces which incorporate a game therein.

Prior to the instant invention, no such switch means were available to easily and quickly control, for example, the displacement of a game element on the face of an electronic timepiece. That is, no such switch means were known to easily control the game elements to be displaced up, down, left or right on the face of a timepiece. In a game in which a maze is presented and a game piece must be "steered" through the maze from one end to the other, such a joystick control is extremely desirable. Furthermore, in a more complex microcomputer-controlled game, such a joystick switch is needed in order to control the movement of the game element across the face of the timepiece or "game board".

In the conventional type of combination timepieces and games, which are primarily game watches, momentary contact or single-throw switches are utilized to control those time-keeping functions and operations. However, such conventional switches are impractical for use in a game watch or other game timepiece in which the object of the game requires the displacement of the game element across the game face and, particularly, where the game element need be displaced in a random manner while the game is in play. It would be very difficult indeed to utilize four separate conventional-type switches, one each to control up, down, left and right movements. Were such conventional switches used, the game user would not be able to play the game for several reasons.

Firstly, the game user's concentration on the play of the game would be broken every time the user wanted to respond to the play of the game by causing the game element to be displaced, since the user would have to remember which one of the four switches would cause the game element to be displaced in the desired direction. This break in concentration and the resulting time lapse would render the playing of such a game, particularly on a watch face, practically impossible, and of no entertainment value.

Secondly, the use of four separate switches to control game element displacement is undesirable because it does not lend itself to developing the eye-hand coordination necessary to play the game. Rather, the use of four switches would inhibit the development of such an attribute, which would again remove all entertainment value from such a game.

Thirdly, it would be physically difficult to play such a game by using separate switches to control displacement of the game element, especially where the game is configured on a timepiece or watch, since four digits and both of the user's hands would be required to actuate the switches. This would necessitate holding the game timepiece in both of the user's hands and attempting to then actuate the proper switches while at the same time concentrating on the play of the game. This would indeed be a most difficult, if not impossible, task and would again destroy any entertainment or educational value of the game timepiece.

SUMMARY AND OBJECTS OF THE INVENTION

In view of the foregoing, it is apparent that a need exists in the art for a control switch for electronic game timepieces having a game mode, in which at least one game element is displaceably moved across the game face by action of the user, wherein the switch is configured as an easy-to-use four function joystick-type control switch. It is, therefore, a primary object of this invention to provide a joystick control switch for use in a game timepiece in which a game element is to be displaced by the user in a desired direction and for a desired distance as part of conducting the play of the game.

More particularly, it is an object of this invention to provide a digital electronic timepiece, such as a watch having a microprocessor unit that controls the time-keeping function and a game playing function, with a joystick control switch which enables the player to easily, rapidly and correctly cause a game element to be displaced in a desired direction by a desired amount, in response to the play of the game as displayed on the face of the timepiece.

It is another object of this invention to provide a digital electronic game watch with a joystick control switch for causing displacement of a game element on the game face of the watch in which the joystick is configured to be permanently affixed to the watch case and can be telescoped outwardly from said case when the user so desires.

It is still another object of this invention to provide a joystick type of control switch for use with a digital electronic game watch, in which the joystick is in the form of slender cylindrical rod which may be threaded into a socket mounted on the watch case, which socket contains the switch contacts.

Briefly described, these and other objects of the invention are accomplished by the provision of a joystick control switch for use with a combination timepiece and a user interactive game in which a standard metal-gate CMOS integrated circuit is utilized to perform all functions, in response to, of course, various switch inputs, including the subject joystick control switch. This integrated circuit produces a primary time watch and an alarm watch with a buzzer sound. The joystick control switch is utilized to control the user's game play in a multi-level maze type game. However, as explained hereinbefore, the inventive joystick control switch is not limited to use with only such a game and may be used in any game where the user is required to displace a game element on a game face of a combination game and timepiece.

More specifically, the joystick of the present invention comprises four contacts which are connected between four switch pins and ground on the CMOS integrated circuit. In its preferred embodiment, the joystick is comprised of a rubber cylindrical body having a conductive rubber contact element attached to one end thereof. Movement of the rubber body is accomplished by threading a slender metal cylindrical rod into the internally threaded rubber body. Movement of the thus assembled joystick control switch causes the conductive rubber element to touch one of the four switch contacts or conductors. When not in use, the slender metal rod may be carried by a clip attached to the underside of the watch case or in a cylindrical compartment formed in the watch band.

In another embodiment, the rubber body portion of the assembled joystick may instead be constituted by a spring-loaded switch. In either embodiment, the joystick control switch may be comprised instead of a telescoping cylindrical rod permanently fastened to either of the above-described socket structures. In use, the player need simply pull on the telescoping rod to raise it to its full height. Of course, it is also possible for the user to actuate the switch by digital manipulation of the socket structure without the joystick rod being affixed thereto.

Although in the preferred embodiment the joystick control switch is mounted on the front portion of the watch case, it may instead be mounted on the side of the watch case.

DETAILED DESCRIPTION OF THE PREFERRED EMBODIMENT

Figure 1:
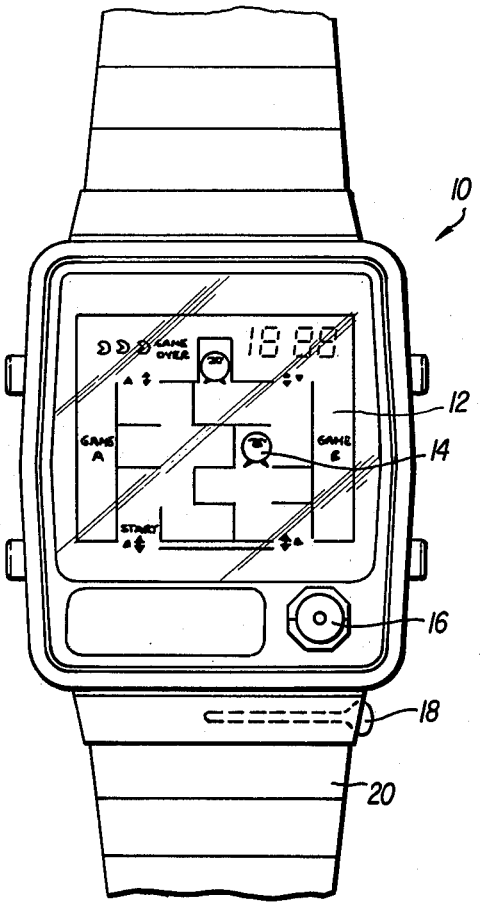
FIG. 1 is a plan view of the face of the game watch of this invention upon which the joystick control switch may be mounted.
Figure 2:
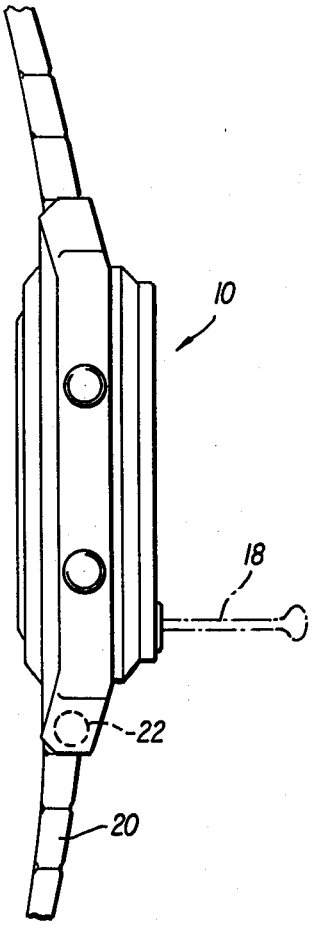
FIG. 2 is a side view of the game watch of FIG. 1 and illustrates the joystick control switch extending from the front face thereof.

Referring now in detail to the drawings wherein like parts are designated by like reference numerals throughout, there is disclosed in FIGS. 1 and 2 a game watch 10 on which the joystick control switch of the present invention may be mounted. The game watch 10 may for instance be a six-function primary time watch. That is, it provides hour, minutes, seconds, month, date and day of the week information. In addition, the game watch 10 also provides a multi-level maze type game with which the player can interact. The game includes an LC display 12 having at least one game element 14 which may be displaceably moved up, down, right or left across the face 12 of the game watch 10. Although the joystick control switch of the present invention is described in connection with its mounting upon a game watch, it is to be understood that the joystick control switch may be mounted upon any timepiece, including, for example, a clock.

The game watch 10 is provided with a joystick control switch socket 16 on the front portion 15 thereof. Further details of this socket are shown in FIGS. 4, 5 and 7A–7C. A joystick rod 18, adapted to be inserted into the socket 16, may be stored in a suitable compartment 22 formed in a band 20 of the watch 10 when not in use. The joystick rod 18 may be formed from any suitable material, such as metal, plastic, etc. The joystick rod 18 is designed to fit securely within the joystick control switch socket 16 so that a user may easily operate the joystick control switch of the present invention in order to displace a game element 14 across the face 12 of the game watch 10.

Figure 3:
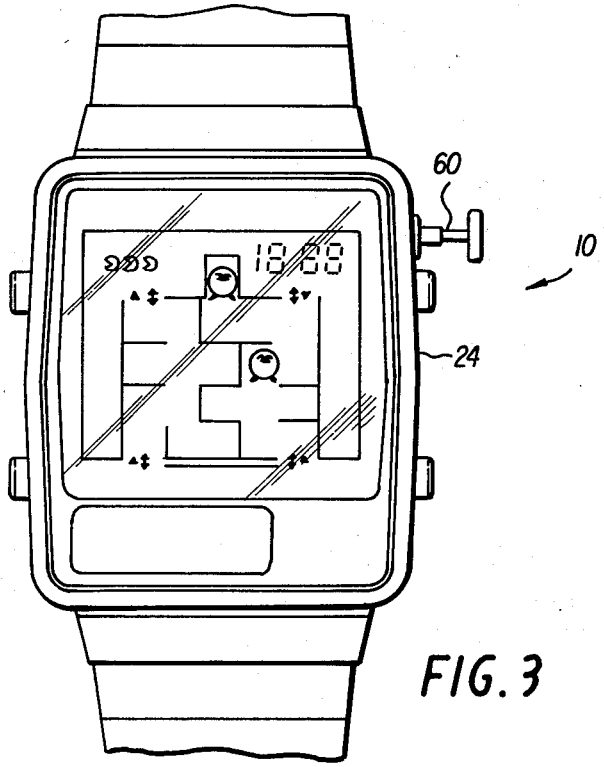
FIG. 3 is a plan view of the game watch in which the joystick control switch is mounted on the side case thereof.

FIG. 3 shows the same game watch 10 illustrated in FIG. 1, with the exception that the joystick control switch socket 16 is mounted in a side 24 of the watch case. In all other respects, the joystick control switch socket 16 is constructed and functions in the exact manner, whether it is located on the front portion 15 of the watch, or on the side casing 24 of the game watch 10.

Figure 4:
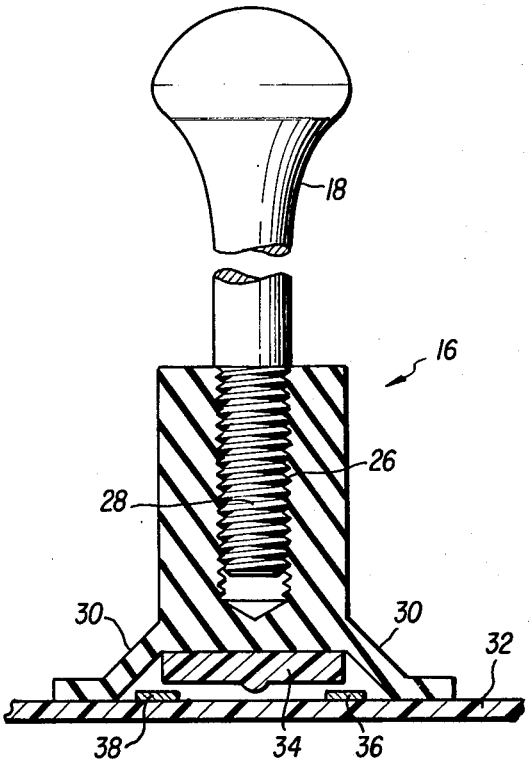
FIG. 4 is a partial vertical sectional view taken through one embodiment of the joystick control switch of the present invention.

FIG. 4 shows a preferred embodiment of the joystick control switch socket 16. The socket 16 may be constructed from a resilient rubber, a metallic material, or any other suitable substance. It is of generally cylindrical shape and has a threaded bore 26 extending in the longitudinal direction. The threaded bore 26 is designed to mesh with threads 28 of the joystick rod 18 such that, when the joystick rod 18 is screwed into the joystick socket 16, the resulting construction performs as a one-piece assembly. The socket 16 is mounted by means of resilient leg members 30 to the printed circuit board 32 utilized in the construction of conventional digital electronic watches. The legs 30 are mounted by any suitable means, such as rivets.

Figure 6:
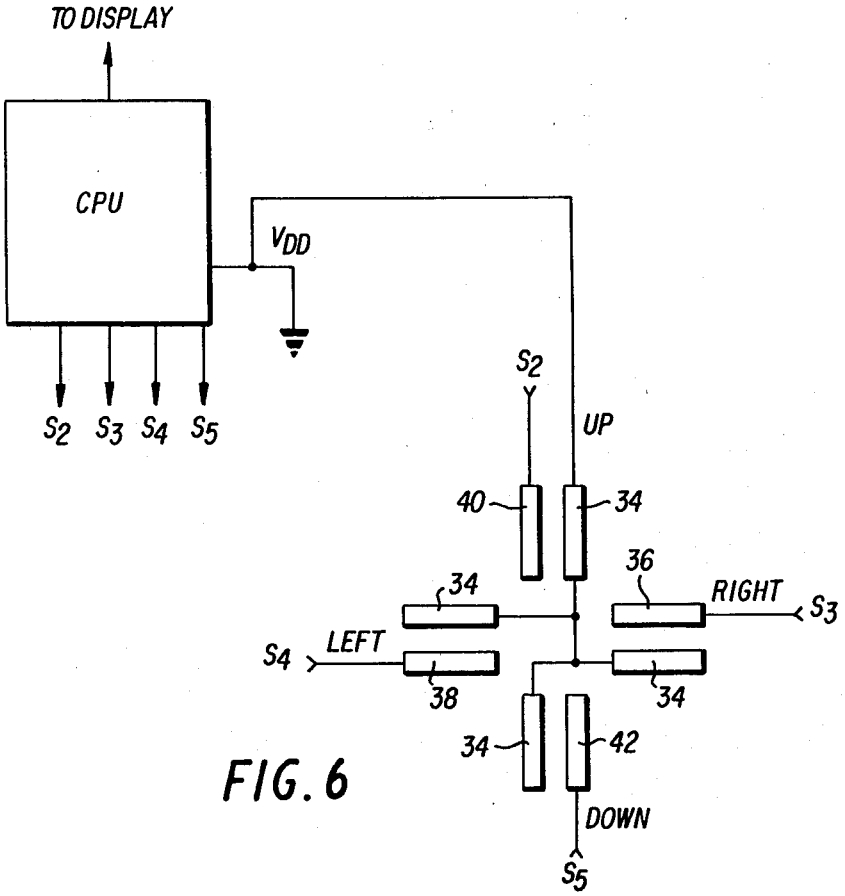
FIG. 6 is a block diagram illustrating the connection of the joystick of the present invention to the CMOS integrated circuit which performs the timekeeping and game playing functions of the timepiece on which the joystick may be mounted.

At the bottom end of the socket 16, that is, the end opposite the bore 26, a conductive rubber contact 34 is affixed. The rubber contact 34 is designed to contact the conductors (only 36 and 38 are shown) mounted on the PC board 32 when the joystick 18 is moved into one of its four operating positions. For instance, as shown in FIG. 4, when the joystick assembly is moved to the right, the contact 34 touches conductor 36 and, for instance, will cause the game element 14 to be displaced to the right on the game face 12 of the game watch 10. As shown in FIG. 6, four contacts 36, 38, 40 and 42 are utilized in order to be able to displace the game element 14 in the right, left, up and down directions.

Figure 7C:
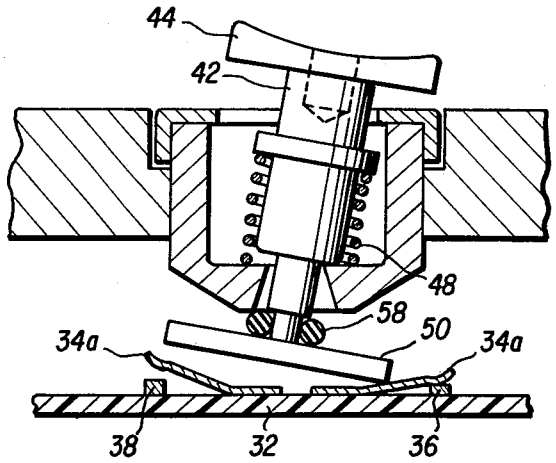
FIGS. 7A–7C are partial vertical sectional views of still another embodiment of the joystick control switch of the present invention, in retracted, extended and angled positions.
Figure 7B:
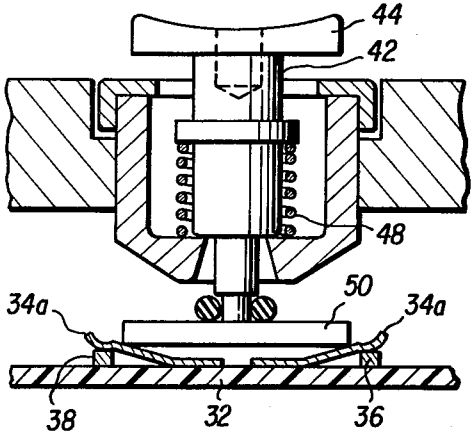
Figure 7A:
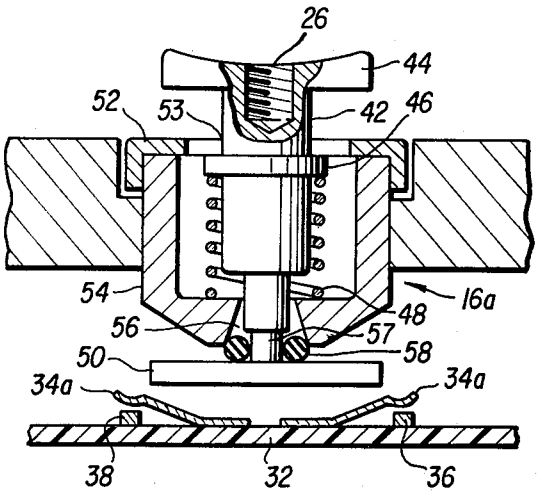

FIG. 7 shows another construction of the joystick control switch socket 16. As shown in FIG. 7A, the joystick switch control socket **16*a*** is in its non-contacting position. Since the construction of each of the FIGS. 7A–7C is identical, they will be described only in connection with FIG. 7A.

This embodiment of the joystick control switch socket **16*a* is comprised of a plunger 42 having an annular ring 44 with a threaded cylindrical bore 26 in the center thereof for receipt of the joystick control switch rod 18 therein. The plunger 42 has a retainer 46 affixed to the plunger 42 opposite the annular ring 44 for retaining a spring 48 which serves to bias a disc 50, mounted at the other end of the plunger 42, towards a non-contacting position. The joystick control switch socket 16***a* is mounted in the case of the watch, either on the face portion 15 or the side 24 thereof, by means of a press-fit cup 54 over which a cap 52 is fit. The plunger 42 extends upwardly through a hole 53 formed in the cap 52. The cup 54 has a downwardly facing tapered bore 56 through which the shaft of the plunger 42 passes. The disc 50 is affixed to the end of the plunger 42 which passes through the tapered bore 56. Immediately forward of the point of contact between the plunger 42 and the contact 50, the plunger is provided with a stepped-down portion 57. upon which an annular rubber or fiber ring 58 is mounted. When the joystick control switch socket 16*a* is in its non-contacting position, as shown in FIG. 7A, this annular ring 58 fits within the outermost portion of the tapered bore 56 and serves as the stop for the socket 16*a*.

Four spring contacts 34*a* (only 2 are shown) are mounted to the printed circuit board 32 by suitable means and are spaced away from the board 32 and the disc 50. The four conductors 36, 38, 40 and 42 (only 36 and 38 are shown) are mounted on the printed circuit board 32 directly beneath the contacting portion of these spring contacts 34*a*. Thus, when the disc 50 is in its contacting position, as shown in FIG. 7C, the disc 50 moves the spring contact 34*a* to contact the conductor 36.

Referring now to FIG. 7B, when the plunger 42 is moved downwardly, the spring 48, mounted between the stop 46 and the cup 54 is compressed, thus allowing the disc 50 to move all four spring contacts 34*a* into engagement with all conductors 36, 38, 40 and 42 (only conductors 36 and 38 are shown).

FIG. 7C shows the operation of the joystick control switch socket 16*a* to control the displacement of the game element 14. In this instance, the contact 50 has moved the spring contact 34*a* so that it is touching the conductor 36, which will cause the game element to move to the right. The annular ring 58 again acts as a stop to the movement of the plunger 42 when the socket 16*a* is at an angled position. The spring contacts 34*a*, as shown, may be constructed from any suitable material, such as leaf spring contact material.

Figure 5:
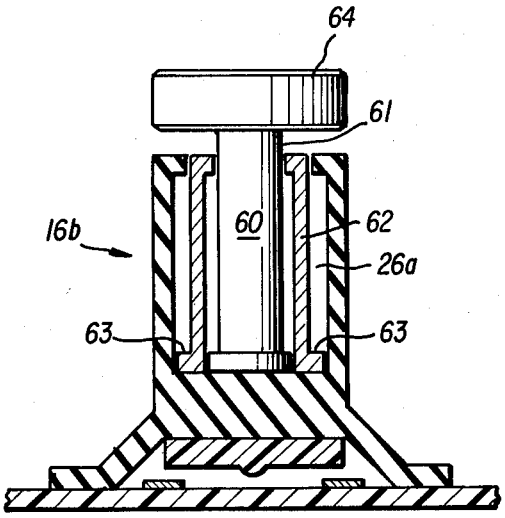
FIG. 5 is a partial vertical sectional view of another embodiment of the joystick control switch of the present invention.

A telescopic version of the joystick control switch of the present invention is shown in FIG. 5. It should be understood that either of the constructions of the joystick control switch sockets 16 or 16*a* may be constructed instead as a telescopic joystick control switch assembly as shown in FIG. 5. The telescoping joystick 60 is mounted by suitable means within a bore 26*a* in the cylindrical joystick control switch socket 16*b*. The telescoping joystick 60 may be comprised of a plurality of elements 61 and 62, which are designed to telescope within one another. The bottom portion of the largest diameter element is constructed to be permanently retained by suitable means for example, by elements 63, within the bore 26*a*. The telescoping joystick 60 may also include a head portion 64 which may be used by the user to extend the telescoping joystick 60 from its closed to its fully extended position. In all other respects, the telescoping joystick switch socket 16*b* functions and is constructed exactly the same as the joystick control switch socket 16 shown in FIG. 4.

FIG. 6 shows an electrical block diagram of the joystick control switch of the present invention and its connection to the integrated circuit which provides both the timekeeping and game functions of a game watch as disclosed in the inventor's patent applications recited hereinabove. The integrated circuit may be, for example, a ten digit multiplexed LCD multi-function watch circuit such as model MSM5050/27, which is a dedicated MSM5050 chip, and is manufactured the the Oki Electric Industry Co., Ltd., Tokyo, Japan. This chip is provided with at least four switch pins, and a pin $V_{DD}$. Each of the conductors 36, 38, 40 and 42 may be connected respectively to switch pins S3, S4, S2 and S5. The $V_{DD}$ pin is grounded and is connected to the contact(s) 34 (a). Thus, when the joystick is moved to one of its extreme angled positions, the contact 34 (a) is caused to touch one of the conductors 36, 38, 40 or 42, which shorts the suitable switch pin S2–S5 to ground, actuating the integrated circuit 70 to displace the game element 14 in the indicated direction.

Although only a preferred embodiment of the invention is specifically illustrated and described herein, it will be appreciated that many modifications and variations of the present invention are possible in light of the above teachings and within the purview of the appended claims without departing from the spirit and intended scope of the invention.

I claim:

1. An electronic game timepiece having a display device for displaying game elements and electronic circuitry including a printed circuit board having a plurality of conductors thereon connecting electronic-circuit elements on said printed circuit board to drive said display device;

said electronic timepiece including a casing having said display device and said electronic circuitry mounted therein;

a joystick-type switch mounted on said timepiece casing and adapted to be moved into a plurality of contacting positions;

said joystick-type switch having contacting means normally spaced a distance away from said printed circuit board conductors; and a plurality of conductors mounted on said printed circuit board in close proximity and corresponding to said contacting means of said joystick-type switch, said plurality of conductors being connected to said electronic-circuit elements such that movement of said joystick-type switch into each of its contacting positions causes simulated displacement of at least one of said game elements across said display device.

2. The electronic game timepiece of claim 1, wherein said joystick-type switch further comprises:

a switch socket mounted at its inner face to said printed circuit board by resilient members;

said switch socket being of generally cylindrical shape and having a threaded longitudinal bore at its outer face;

said contacting means being mounted to said inner face of said switch socket; and a generally cylindrically shaped rod having threads at one end for engaging with said threaded bore, said rod extending axially outwardly from said bore.

3. The electronic game timepiece of claim 1, wherein said joystick-type switch further comprises:

a switch socket mounted at its inner face to said printed circuit board by resilient members;

said switch socket being of generally cylindrical shape and having a longitudinal bore at its outer face;

said contacting means being mounted to said inner face of said switch socket; and a generally cylindrically shaped telescoping rod being fixed in said longitudinal bore, said telescoping rod extending axially outwardly from said bore.

4. The electronic game timepiece of claims 2 or 3, wherein said timepiece includes a band having means thereon for securing said generally cylindrical rod of said joystick-type switch.

5. The electronic game timepiece of claim 4, wherein said means for securing comprises an elongated compartment formed in said band.

6. The electronic game timepiece of claims 2 or 3, wherein said timepiece casing includes a front portion on which said switch socket is mounted.

7. The electronic game timepiece of claims 2 or 3, wherein said switch socket is mounted to said timepiece casing.

8. The electronic game timepiece of claim 1, said timepiece casing including a front portion on which said switch socket is mounted, wherein said joystick-type switch further comprises:

plunger means resiliently biased between upper cap and lower cup-shaped members, said lower cup-shaped member being press-fitted into said front portion and said upper cap member being press-fitted onto said lower cup-shaped member;

said plunger means having an outer face and a threaded longitudinal bore therein;

said plunger means having an inner face to which said contacting means is affixed; and annular resilient stopping means, mounted on said plunger means in the vicinity of said contacting means for maintaining said contacting means in spaced relationship to said lower cup-shaped member when said switch socket is in a non-contacting position.

9. The electronic game timepiece of claim 8, wherein said lower cup-shaped member includes a downwardly tapering bore positioned such that when said joystick-type switch is in each of its contacting positions, said plunger means does not contact said bore of said lower cup-shaped member.

10. The electronic game timepiece of claim 8, further including:

a plurality of spring contacting means mounted to said printed circuit board and spaced between said contacting means and said plurality of conductors corresponding to said contacting means such that, when said joystick-type switch is operated to move into each of its contacting positions, one of said plurality of spring contacting means is moved by said contacting means to contact a corresponding one of said plurality of conductors.

* * * * *